US009062554B2

(12) United States Patent
Bielek

(10) Patent No.: US 9,062,554 B2
(45) Date of Patent: Jun. 23, 2015

(54) GAS TURBINE NOZZLE WITH A FLOW GROOVE

(75) Inventor: Craig Allen Bielek, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 326 days.

(21) Appl. No.: 13/342,261

(22) Filed: Jan. 3, 2012

(65) Prior Publication Data

US 2013/0170977 A1 Jul. 4, 2013

(51) Int. Cl.
*F01D 5/14* (2006.01)

(52) U.S. Cl.
CPC ..... *F01D 5/141* (2013.01); *F01D 5/145* (2013.01)

(58) Field of Classification Search
CPC ..... F04D 29/24; F04D 29/242; F04D 29/245; F04D 29/32; F04D 29/388; F04D 29/542; F04D 29/544; F01D 1/02; F01D 5/142; F01D 5/145; F01D 9/02; F01D 9/041; F05D 2240/307; F05D 2240/306; F05D 2250/294
USPC ..... 415/191, 208.1, 208.2; 416/223 R, 416/231 B, 235, 236 R, 236 A, 243, 228
See application file for complete search history.

(56) References Cited

U.S. PATENT DOCUMENTS

| | | | | |
|---|---|---|---|---|
| 1,152,426 | A | | 9/1915 | McCarroll |
| 2,041,793 | A | | 5/1936 | Stalker |
| 2,573,834 | A | | 11/1951 | Davidson |
| 2,650,752 | A | | 9/1953 | Hoadley |
| 3,588,005 | A | | 6/1971 | Rethorst |
| 3,973,870 | A | * | 8/1976 | Desai ..... 415/169.4 |
| 4,706,910 | A | | 11/1987 | Walsh et al. |
| 4,884,944 | A | | 12/1989 | Tate |
| 5,151,014 | A | * | 9/1992 | Greenwald et al. ..... 416/237 |
| 5,332,360 | A | | 7/1994 | Correia et al. |
| 5,337,568 | A | | 8/1994 | Lee et al. |
| 5,520,512 | A | * | 5/1996 | Walker et al. ..... 415/199.5 |
| 5,738,298 | A | | 4/1998 | Ross et al. |
| 6,652,220 | B2 | | 11/2003 | Powis et al. |
| 7,604,461 | B2 | | 10/2009 | Bonnet |
| 7,648,334 | B2 | | 1/2010 | Hurst et al. |
| 2006/0060722 | A1 | | 3/2006 | Choi et al. |
| 2008/0298973 | A1 | | 12/2008 | Marini |
| 2009/0324400 | A1 | | 12/2009 | Marini et al. |

(Continued)

FOREIGN PATENT DOCUMENTS

| | | | |
|---|---|---|---|
| DE | 700625 | | 12/1940 |
| EP | 1371813 | A1 | 12/2003 |
| FR | 2938871 | A1 | 5/2010 |

(Continued)

OTHER PUBLICATIONS

JP55072602A Translation. FLS, Inc. Washington D.C. Mar. 2014. 6 Pages.*

(Continued)

*Primary Examiner* — Dwayne J White
*Assistant Examiner* — William Grigos
(74) *Attorney, Agent, or Firm* — Sutherland Asbill & Brennan LLP

(57) ABSTRACT

The present application provides a turbine nozzle. The turbine nozzle may include an airfoil with a leading edge and a trailing edge and a flow groove extending from the leading edge to the trailing edge.

16 Claims, 3 Drawing Sheets

(56) References Cited

U.S. PATENT DOCUMENTS

| | | | | |
|---|---|---|---|---|
| 2010/0135813 | A1* | 6/2010 | Marini et al. | 416/223 R |
| 2011/0280712 | A1* | 11/2011 | Graefe et al. | 415/148 |

FOREIGN PATENT DOCUMENTS

| | | | | |
|---|---|---|---|---|
| JP | 55072602 | A * | 5/1980 | F01D 5/14 |
| SU | 1677346 | A1 | 9/1991 | |
| WO | 9844240 | A1 | 10/1998 | |

OTHER PUBLICATIONS

M.J. Walsh, Title: "Grooves reduce aircraft drag", NASA Technical Reports Server (NTRS), Date: Sep. 1, 1980, pp. 1.

EP Search Report and Written Opinion dated Feb. 19, 2014 issued in connection with corresponding EP Application No. 12198416.5.

* cited by examiner

GAS TURBINE NOZZLE WITH A FLOW GROOVE

TECHNICAL FIELD

The present application and the resultant patent relate generally to a turbine nozzle for a gas turbine engine and more particularly relate to a turbine nozzle with a flow groove positioned on a suction side or elsewhere so as to limit radial now migration and turbulence.

BACKGROUND OF THE INVENTION

In a gas turbine, many system requirements should be met at each stage of the gas turbine so as to meet design goals. These design goals may include, but are not limited to, overall improved efficiency and airfoil loading capability. As such, a turbine nozzle airfoil profile should achieve thermal and mechanical operating requirements for a particular stage. For example, last stage nozzles may have a region of significantly high losses near an outer diameter. These loses may be related to radial flow migration along an inward suction side. Such radial flow migration may combine with mixing losses so as to reduce blade row efficiency. As such, a reduction in radial now migration with an accompanying reduction in the total pressure loss should improve overall performance and efficiency.

There is thus a desire for an improved turbine nozzle design, particularly for a last stage nozzle. Such an improved turbine nozzle design should accommodate and/or eliminate radial flow migration and associated loses about the airfoil. Such a reduction in radial flow migration and the like should improve overall performance and efficiency. Overall cost and maintenance concerns also should be considered and addressed herein.

SUMMARY OF THE INVENTION

The present application and the resultant patent provide an example of a turbine nozzle. The turbine nozzle described herein may include an airfoil with a leading edge and a trailing edge and a flow groove extending from the leading edge to the trailing edge.

The present application and the resultant patent further provide an example of a turbine. The turbine described herein may include a number of stages with each of the stages including a number of nozzles and a number of buckets. Each of the buckets may include an airfoil with a leading edge, a trailing edge, and a flow groove extending therebetween.

The present application and the resultant patent further provide an example of a turbine nozzle airfoil. The turbine nozzle airfoil described herein may include a leading edge, a trailing edge, a pressure side, a suction side, and a flow groove extending from the leading edge to the trailing edge along the suction side. Other configurations may be used.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
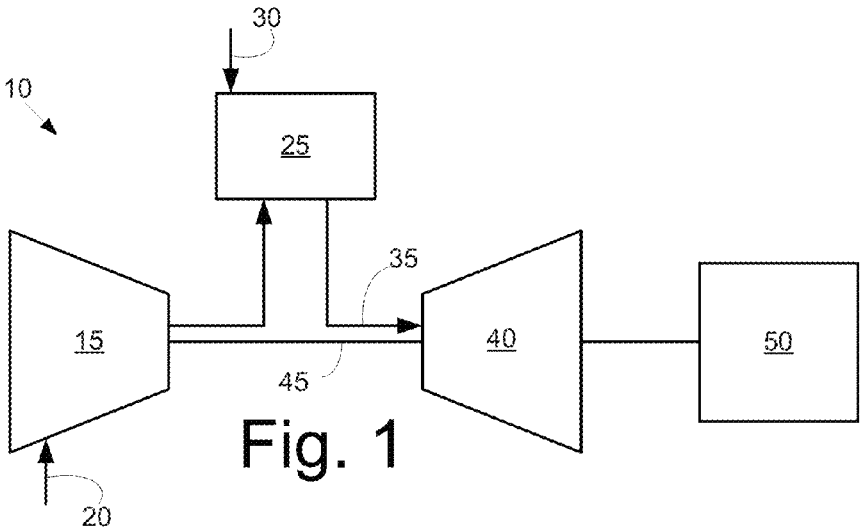
FIG. 1 is schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
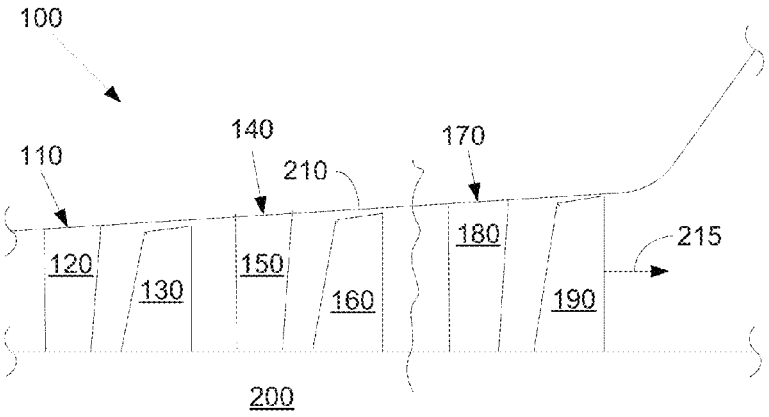
FIG. 2 is a schematic diagram of a portion of a turbine with a number of nozzles and a number of buckets as may be described herein.

FIG. 2 shows an example of a portion of a turbine 100 as may be described herein. The turbine 100 may include a number of stages. In this example, the turbine 100 may include a first stage 110 with a number of first stage nozzles 120 and a number of first stage buckets 130, a second stage 140 with a number of second stage nozzles 150 and a number of second stage buckets 160, and a last stage 170 with a number of last stage nozzles 180 and a number of last stage buckets 190. Any number of the stages may be used herein with any number of the buckets 130, 160, 190 and any number of the nozzles 120, 150, 180.

The buckets 130, 160, 190 may be positioned in a circumferential array on a rotor 200 for rotation therewith. Likewise, the nozzles 120, 150, 180 may be stationary and may be mounted in a circumferential array on a casing 210 and the like. A hot gas path 215 may extend therethrough the turbine 100 for driving the buckets 130, 160, 190 with the flow of combustion gases 35 from the combustor 25. Other components and other configurations also may be used herein.

FIGS. 3-6 show an example of a nozzle 220 as may be described herein. The nozzle 220 may be one of the last stage nozzles 180 and/or any other nozzle in the turbine 100. The nozzle 220 may include an airfoil 230. Generally described, the airfoil 230 may extend along an X-axis from a leading edge 240 to a trailing edge 250. The airfoil 230 may extend along a Y-axis from a pressure side 260 to a suction side 270. Likewise, the airfoil 230 may extend along a Z-axis from a platform 280 to a tip 290. The overall configuration of the nozzle 220 may vary. Other components and other configurations may be used herein.

The nozzle 220 may have a flow groove 300 positioned about the airfoil 230. The flow groove 300 may be positioned near the tip 290 of the airfoil 230, i.e., the flow groove 300 may be positioned closer to the tip 290 than the platform 280. The flow groove 300 may extend inwardly from the leading edge 240 to the trailing edge 250 along the suction side 270. The flow groove 300 may smoothly blend into the leading edge 240 and the trailing edge 250. The flow groove 300 may extend in a largely linear direction 320 along the suction side 270 although other directions may be used herein. The flow groove 300 may have a largely V or U-shaped configuration 310 although other configurations may be used herein. Specifically, the flow groove 300 may have any size, shape, or configuration.

Figure 3:
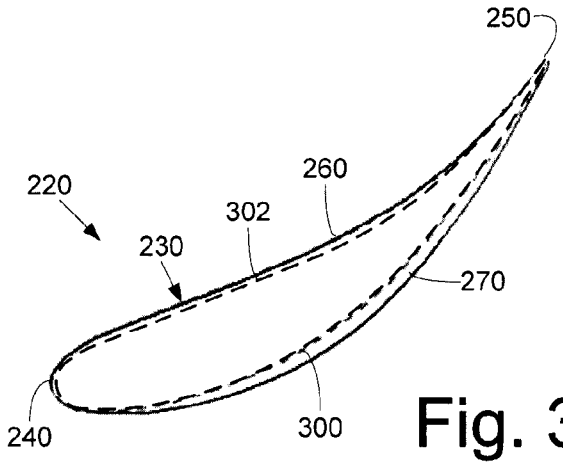
FIG. 3 is a side cross-sectional view of an example of a nozzle as may be used in the turbine of FIG. 2.
Figure 4:
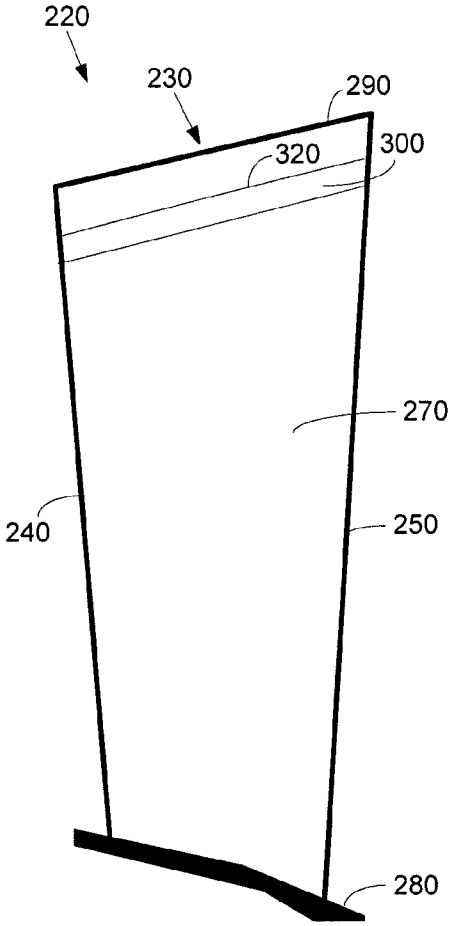
FIG. 4 is a side plan view of the nozzle of FIG. 3 with a flow groove positioned therein.
Figure 5:
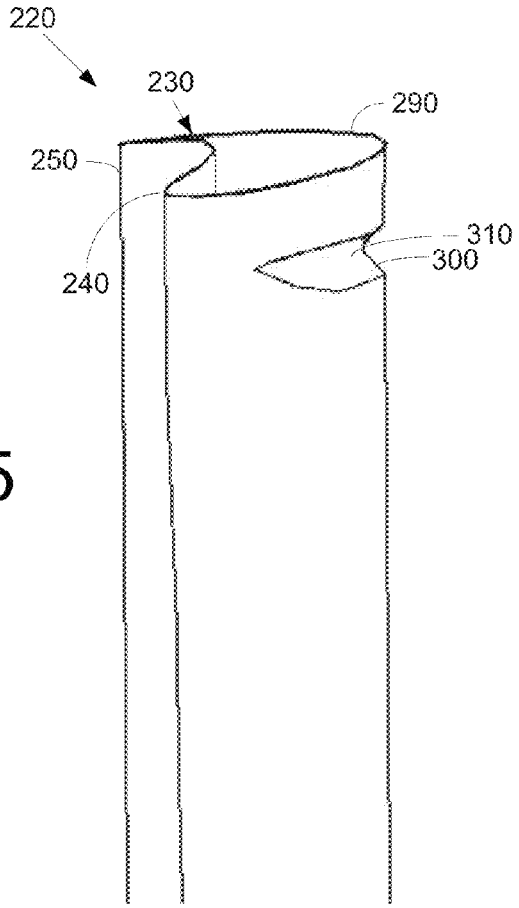
FIG. 5 is a leading edge view of the nozzle of FIG. 3.
Figure 6:
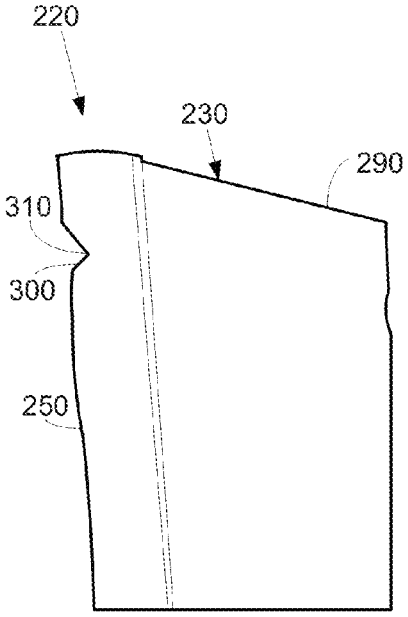
FIG. 6 is a trailing edge view of the nozzle of FIG. 3.

More than one flow groove 300 may be used herein. Although the flow groove 300 has been discussed in terms of the suction side 370, a flow groove 300 also may be positioned on the pressure side 260, for example as shown in FIG. 3, with flow groove 302 positioned on the pressure side 260, and/or a number of flow grooves 300 may be positioned along both the suction side 270 and the pressure size 260. The number, positioning, and configuration of the flow grooves 300 thus may vary herein. Other components and other configurations may be used herein.

The use of the flow groove 300 about the nozzle 220 thus acts to direct the flow of combustion gases 35 in an axial direction so as to reduce the amount of radial flow migration. Reduction in the extent of the radial flow migration may be accompanied by a reduction in total pressure losses so as to improve overall blade row efficiency and performance. The flow groove 300 thus acts as a physical barrier to prevent such flow migration in that the flow groove 300 channels the flow in the desired direction. The use of the flow groove 300 also may be effective in reducing turbulence thereabout.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A turbine nozzle, comprising:

an airfoil extending from a base to a tip, wherein the tip of the airfoil is inclined along a rotor axis;

the airfoil comprising a leading edge and a trailing edge; and a flow groove extending inwardly from a suction side surface of the airfoil such that the flow groove has a depth measured from the suction side surface of the airfoil, the flow groove substantially parallel to the tip of the airfoil;

the flow groove extending from the leading edge to the trailing edge only along the suction side of the airfoil;

wherein the flow groove blends into the suction side surface at the leading edge and the trailing edge of the airfoil, such that a first depth of the flow groove at either the leading edge or the trailing edge of the airfoil is less than a second depth of the flow groove along the side of the airfoil.

2. The turbine nozzle of claim 1, wherein the flow groove is positioned adjacent to the tip.

3. The turbine nozzle of claim 1, wherein the flow groove comprises a substantial V-like shape.

4. The turbine nozzle of claim 1, wherein the flow groove extends in a substantially linear direction.

5. The turbine nozzle of claim 1, wherein the turbine nozzle comprises a last stage nozzle.

6. The turbine nozzle of claim 1, further comprising a plurality of flow grooves.

7. The turbine nozzle of claim 1, wherein the flow groove is shaped to reduce flow migration in a flow of hot combustion gases along the airfoil.

8. A turbine, comprising:

a plurality of nozzles; and a plurality of buckets;

the plurality of buckets comprising an airfoil;

the airfoil extending from a base to a tip, wherein the tip of the airfoil is inclined along a rotor axis, the airfoil comprising a leading edge, a trailing edge, a suction side and a flow groove extending only along the suction side of the airfoil between the leading edge and the trailing edge;

wherein the flow groove extends inwardly from the suction side of the airfoil such that the flow groove has a depth measured from the suction side of the airfoil, the flow groove substantially parallel to the tip of the airfoil; and the flow groove blends into the suction side at the leading edge and the trailing edge of the airfoil, such that a first depth of the flow groove at either the leading edge or the trailing edge of the airfoil is less than a second depth of the flow groove along the suction side of the airfoil.

9. The turbine of claim 8, wherein the flow groove is positioned adjacent to the tip.

10. The turbine of claim 8, wherein the flow groove comprises a substantial V-like shape.

11. The turbine of claim 8, wherein the flow groove extends in a substantially linear direction.

12. The turbine of claim 8, further comprising a plurality of flow grooves.

13. The turbine of claim 8, wherein the flow groove is shaped to reduce flow migration in a flow of hot combustion gases along the airfoil.

14. A turbine nozzle airfoil, comprising:

an airfoil extending from a base to a tip, wherein the tip of the airfoil is inclined along a rotor axis, the airfoil comprising:

a leading edge;

a trailing edge, a pressure side;

a suction side; and a flow groove extending from the leading edge to the trailing edge only along the suction side;

wherein the flow groove extends inwardly from the suction side of the airfoil such that the flow groove has a depth measured from the suction side of the airfoil, the flow groove substantially parallel to the tip of the airfoil; and the flow groove blends into the outer surface at the leading edge and the trailing edge of the airfoil, such that a first depth of the flow groove at either the leading edge or the trailing edge of the airfoil is less than a second depth of the flow groove along the suction side of the airfoil.

15. The turbine nozzle airfoil of claim 14, wherein the flow groove is positioned adjacent to the tip.

16. The turbine nozzle airfoil of claim 14, wherein the flow groove comprises a substantial V-like shape.

* * * * *